United States Patent [19]

Harke

[11] Patent Number: 4,741,141

[45] Date of Patent: May 3, 1988

[54] BRACKET-STYLE SUPPORT ELEMENT FOR CURTAIN FACADES ON BUILDING WALLS

[75] Inventor: Alfons Harke, Affligem-Hekelgem, Belgium

[73] Assignee: International INTEC, co. Establishment, Belgium

[21] Appl. No.: 855,696

[22] Filed: Apr. 25, 1986

[30] Foreign Application Priority Data

Apr. 26, 1985 [DE] Fed. Rep. of Germany ..... 3515146

[51] Int. Cl.[4] ..... E04B 1/4

[52] U.S. Cl. ..... 52/506; 52/704

[58] Field of Search ..... 52/125.4, 506, 510, 52/488, 485, 778, 633, 732, 743, 97, 704–707; 411/23, 395

[56] References Cited

U.S. PATENT DOCUMENTS

| | | | |
|---|---|---|---|
| 1,172,406 | 2/1916 | Taylor | 411/395 |
| 1,507,449 | 9/1924 | Anchelevich | 411/395 |
| 2,027,883 | 1/1936 | Ross | 52/488 |
| 2,130,531 | 9/1938 | Arand | 52/485 |
| 2,261,510 | 11/1941 | Atcheson | 52/97 |
| 2,348,314 | 5/1944 | Spalding | 52/778 |
| 2,746,780 | 5/1956 | Comino | 52/732 |
| 2,772,560 | 12/1956 | Neptune | 52/125.4 |
| 3,342,033 | 9/1967 | Crouch et al. | 52/743 |
| 4,262,464 | 4/1981 | Ludowici | 52/510 |
| 4,528,792 | 7/1985 | Cross et al. | 52/743 |

FOREIGN PATENT DOCUMENTS

| | | | |
|---|---|---|---|
| 563056 | 12/1957 | Belgium | 52/633 |
| 2112487 | 7/1983 | United Kingdom | 411/23 |

*Primary Examiner*—James L. Ridgill, Jr.

*Attorney, Agent, or Firm*—Antonelli, Terry & Wands

[57] ABSTRACT

Bracket-style support elements (10) to be mounted subsequently to a building wall (14, 15) for a curtain facade (13) consist of a horizontal support (2) with at least two associated, bolt-like wall mounting elements. In order to make it possible also to use normal facing stones, to be able to anchor the support element securely in the foundation masonry (14, 15), and to ensure reliable protection against wetness as well as good insulation, the wall mounting elements are constituted by grouting anchors (4) surrounded up to the support (2) by a sleeve (7) and exhibiting respectively a central anchoring bolt (5) with a barbed disk (6) arranged at the insert end (22), and the support (2) is constituted by an L-shaped rail (3), the grouting anchors (4) projecting from the vertical leg (8) of this rail on the side facing away from the horizontal leg (9).

17 Claims, 3 Drawing Sheets

BRACKET-STYLE SUPPORT ELEMENT FOR CURTAIN FACADES ON BUILDING WALLS

BACKGROUND OF THE INVENTION

The invention relates to a bracket-style support element for curtain facades on building walls, which support element is subsequently fastened to the building wall with, the support element including a horizontal support with at least two bolt-like wall mounting elements associated therewith.

Curtain facades have been known wherein bracket beams in the manner of a wall shelf board are attached to the outside of building walls with the aid of two dowels. Panel elements for a lining facade are then placed on the bracket beam provided at that location and, depending on the width of the bracket beam, an insulating layer can also be additonally inserted between the basic masonry and the lining shell. In case of very high buildings wherein the load on the bearing dowels would become too large, several bracket beams can be arranged in superposition which then carry individual facade sections. The conventional curtain facade has the advantage that, besides plate-shaped panel elements, it is also possible to brick up normal facing stones on the bracket beams. However, there is the problem that, in case of older buildings, the outer surface of the basic masonry is frequently weathered and thus dowels mounted therein have an only limited load-bearing ability. Another drawback resides in that, by the bracket beams, a direct connection is established from the curtain facade to the basic masonry. Consequently, water running down the inside of the curtain shell is actually conducted toward the basic masonry, simultaneously inundating a possibly installed layer of insulating material. Besides, the bracket beams represent thermally conductive bridges extending over the entire width of the building so that temperature stresses, condensed water formation, and the like can occur in the building walls.

The invention is based on the object of providing a support element of the above type for curtain facades on building walls wherein the use of normal facing stones is likewise possible, which support element can be securely anchored within the basic masonry and ensures reliable protection from wetness as well as good insulation.

This object has been attained according to the invention by providing that the wall mounting elements are grouting anchors enclosed up to the support by a grouting sleeve and each exhibiting a central anchoring bolt with a barbed disk arranged at the insert end; and that the support is an L-shaped rail, the grouting anchors projecting from the vertical leg thereof on the side facing away from the horizontal leg.

Owing to the use of grouting anchors, a very sturdy attachment of the support element can be attained even in relatively old, weathered masonry, the barbed disk located at the insert end providing an especially high extraction resistance of the grouting anchors. Grouting anchors can be inserted with such an extent of cantilevering that a layer of thermal insulating material can be inserted between the L-shaped rail used as the support and the basic masonry.

In the support element according to this invention, merely the grouting anchors, if anything at all, can be considered thermally conductive bridges, but they can conduct an only insubstantial amount of heat on their small cross section.

A special advantage of the support element of this invention resides in that it can be utilized not only in buildings having a single-shell basic masonry, but also for renovation of a multiple-shell masonry already equipped with an enclosing shell, without having to tear down the old enclosing shell. Due to the grouting anchors connected by the L-shaped rail, there results even a stabilization of the multiple-shell foundation structure. In particular, if relatively old air space anchors between the various panels have corroded or have been sheared off, the grouting anchors reestablish connection between the various shells and especially increase the bending and buckling resistance of the old lining facade. The various shells are combined into a unitary, quasi box-shaped total structure. In a further development of the invention, the provision can be made to make the horizontal leg of the support of equal width as the panel elements of the curtain facade, and to respectively arrange one drip plate on the grouting anchors shortly behind the vertical leg. In this embodiment, the grouting anchors project to such an extent that a relatively large air gap remains between the vertical leg of the L-shaped rail and the foundation masonry and/or the thermal insulating layer; this air gap permits unimpeded drainage of water on the inside of the facade shell. The drip plate provided on the grouting anchors takes care of safely preventing, even at the grouting anchors proper, any conductance of water to the basic masonry.

According to the invention, the anchoring bolts can be welded to the vertical leg of the L-shaped rail. In this structure, the bracket-style support elements are mounted as a whole to a building wall.

In accordance with a modified version of the invention, the anchoring bolts can be threaded to the vertical leg of the L-shaped rail. In this embodiment, the individual support elements can be transported to the building site in a disassembled form. Depending on suitability, it is then possible first to use the grouting anchors by themselves, or, alternatively, the complete, presently assembled support elements. Due to the threaded connection, there is the possibility of joining, in the manner of a module system, L-shaped rails of varying length and grouting anchors of differing size in adaptation to the respective requirements. Thus, it is possible, for example, to select one of the two grouting anchors of a support element to be larger if, at the respective location, the foundation masonry is very brittle or if this grouting anchor must absorb additional loads.

According to this invention, the vertical legs of the L-shaped rails can exhibit horizontally oriented slotted holes for the thread-in ends of the anchoring bolts. Due to the slotted holes, spacing discrepancies during insertion of the grouting anchors can be compensated for. However, the essential purpose of the slotted holes resides in the fact that, with the threaded connection of the anchoring bolts exhibiting an only limited firmness, a horizontal relative motion occurs between the L-shaped rail and the grouting anchors for the purpose of compensating for thermal expansions. In this connection, it must be kept in mind that the temperature of the external facade can fluctuate between −20° C. and +80° C., whereas, the temperature of the single- or multiple-shell foundation masonry is subject to only far smaller changes. Thus, the advantage is obtained especially with a multiple-shell basic masonry that, due to the facade shell placed in front thereof, the fluctuations of the outside temperature are compensated for, whereas the shells of the basic masonry are rigidly joined by the grouting anchors, without the danger of thermal stresses, and therefore the basic masonry in total is stabilized.

In a further embodiment of the invention, a joint tube, preferably of the same length as that of an L-shaped rail, can be associated with the support element, this tube being provided with an injection port for injecting mortar. The joint tube serves, in this arrangement, for the watertight sealing of the gap between several superimposed parts of a curtain facade with several support elements. Sealing of this gap has special significance, since at this point the water is drained from the next upper L-shaped rail.

In accordance with this invention, the length of the anchoring bolts can amount to more than thirty centimeters. With this minimum length, the support element can be securely fastened to a double-shell foundation masonry.

In a further embodiment of this invention, connecting elements for scaffoldings or ropes can be attached to the support elements. Since the grouting anchors exhibit a very high extraction resistance, it is also possible without any problems to apply additional stresses to the support elements. The connecting elements can be welded or threaded to the L-shaped rails or to the anchoring bolts of the support elements. The anchoring bolts can also consist of rectangular pipes.

The invention will be described in greater detail below with reference to the drawing wherein:

DETAILED DESCRIPTION

Figure 1:
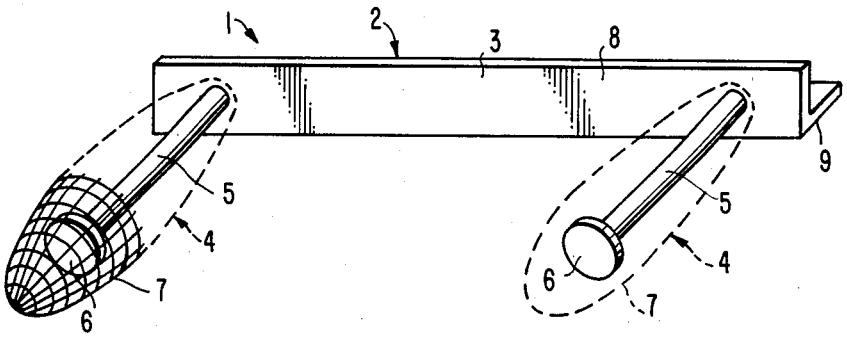
FIG. 1 is a schematic view of a first embodiment of a support element for a curtain facade constructed in accordance with the present invention.

Referring now to the drawings wherein like reference numerals are used throughout the various views to designate like parts and, more particularly, to FIG. 1, according to this figure, a bracket-style support element 1 for a curtain facade on building walls is built up of a horizontal support 2 in the form of an L-shaped rail 3 and two grouting anchors 4, with the grouting anchors 4 respectively including of a central anchoring bolt 5 with a barbed disk 6 arranged at the insert end, which bolt 5 is surrounded up to the support by a fabric grouting sleeve 7. The grouting sleeve 7 is indicated only in a fragmentary view and is otherwise shown by a dashed-line outer contour. The anchoring bolts 5 are welded to a vertical leg 8 of the L-shaped rail 3 in such a manner that they project perpendicularly from the L-shaped rail 3 on the side facing away from the horizontal leg 9.

Figure 2:
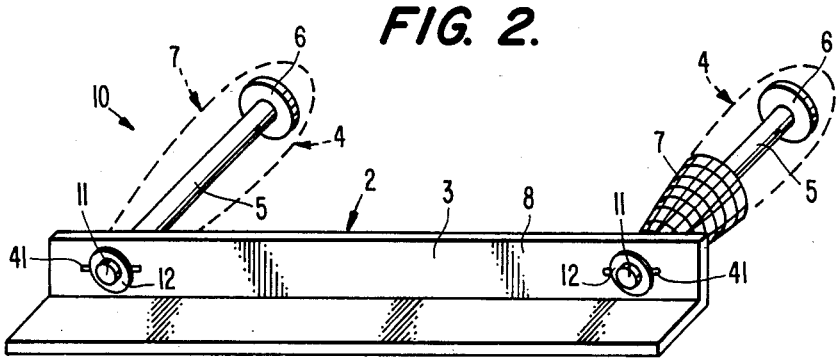
FIG. 2 is a schematic view of a second embodiment of a support element constructed in accordance with the present invention.

In the support element 10 shown in FIG. 2, however, the special feature is that the connection between the vertical leg 8 of the L-shaped rail 3 and the anchoring bolt 5 is established by means of screws 11 with a washer 12.

Figure 3:
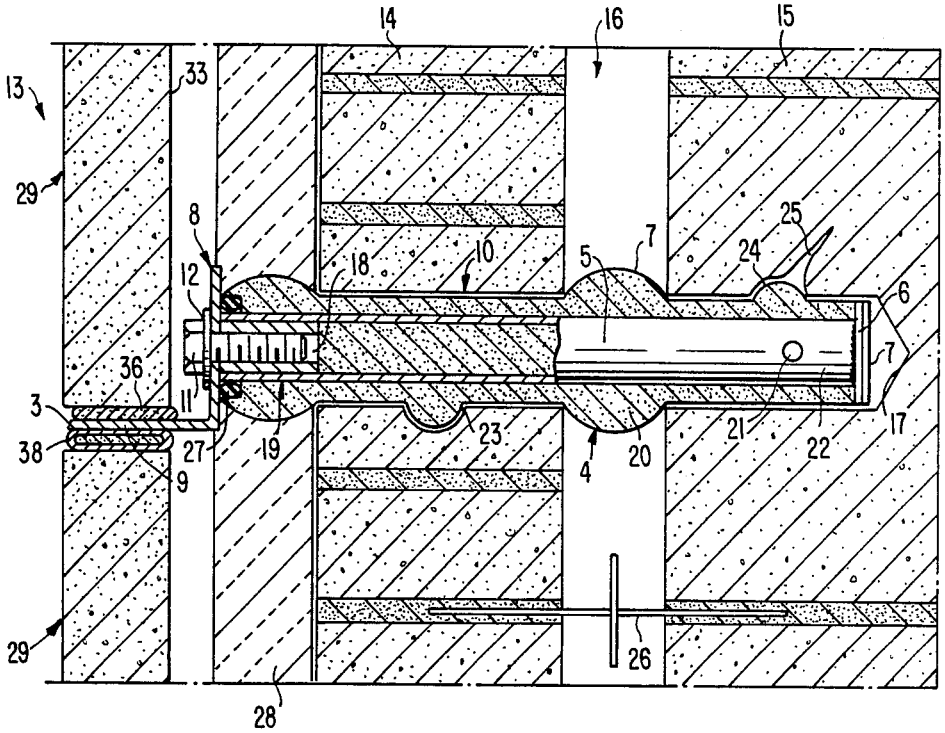
FIG. 3 is a fragmentary cross-sectional view of a curtain facade attached to a double-shell foundation masonry with a support element according to the present invention.
Figure 4:
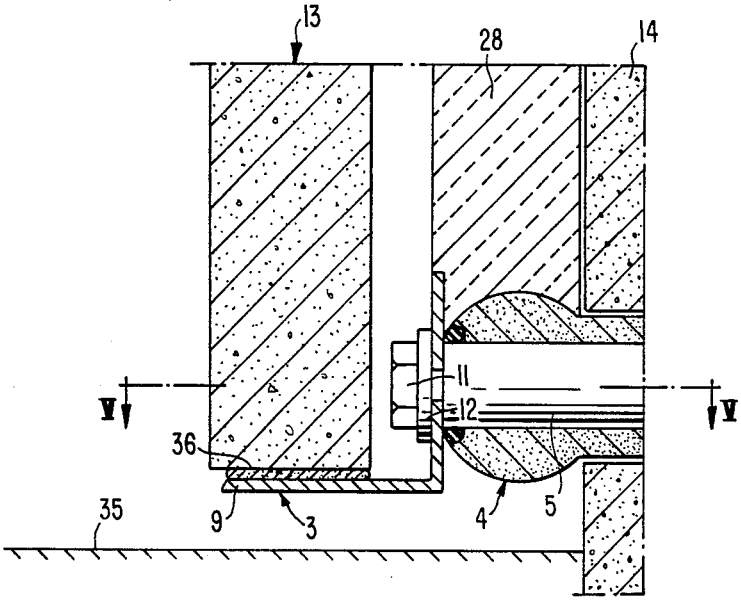
FIG. 4 is a cross-sectional view of a lower rim of a curtain facade of FIG. 3.
Figure 5:
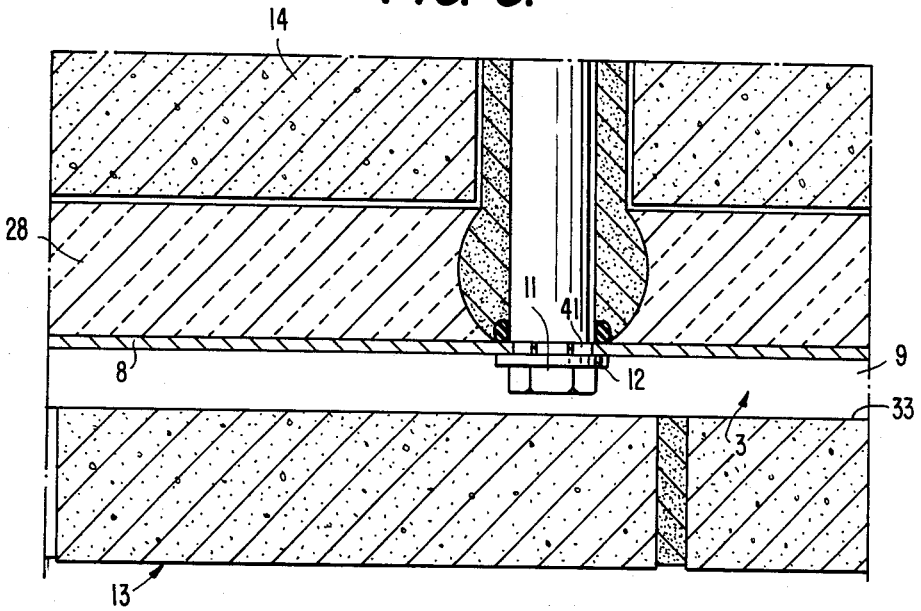
FIG. 5 is a cross-sectional view, taken along a line V—V in FIG. 4.

FIGS. 3–5 illustrate the structure of a curtain facade 13 wherein support elements 10 according to FIG. 2 are utilized. The curtain facade 13 is, in this embodiment, attached to a double-shell basic masonry including a frontal lining shell 14 and a backing masonry shell 15 with an interposed air layer 16. The anchoring bolts 5 of the support elements 10 have a length of somewhat more than thirty centimeters so that they can be inserted in a bore 17 extending through the lining shell 14 up into the backing masonry shell 15.

During the mounting of the novel curtain facade 13 of the present invention, the grouting anchors 4 are first introduced into the drill holes 17. Through grouting bores 18 at the threading-in end 19 of the grouting anchors 4, the hollow anchoring bolt 5 is then filled with grouting compound 20, which latter penetrates to the outside through one or several outlet bores 21 in the proximity of the insert end 22. In this manner, the grouting sleeve 7 is increasingly filled with grouting compound 20 and comes into close contact with the walls of the bore 17. If the walls of the bore 17 are broken out at individual locations 23, 24, the sleeve 7 will enter into these indentations, but simultaneously will prevent excessive outflow of the grouting compound 20 into cracks 25 or the like.

After hardening of the grouting compound 20, a very solid connection results between the grouting anchor 4 and the double-shell masonry 14, 15, the barbed disk 6, now being retained by the grouting compound 20, taking care of a high extraction resistance of the anchoring bolt 5. The barbed disk 6 furthermore prevents, during grouting, a passage of grouting compound 20 into the tip of the drill hole 17 whereby the anchoring bolt 5 could be forced out of the drill hole 17.

Within the air layer 16 between the lining shell 14 and the backing masonry shell 15, the grouting sleeve 7 is widened in the manner of a bulb so that, after hardening of the grouting compound 20, the two shells 14, 15 are mutually supported. When wire anchors 26, already present between the two shells 14, 15, have corroded or have been sheared off, the supporting function exerted by the wire anchors 26, with regard to bending or buckling stress on the lining shell 14, is taken over by the grouting anchor 4.

The grouting anchors 4 project a certain distance from the old lining shell 14 so that the L-shaped rail 3 can be threadedly attached to the grouting anchors 4 at a spacing with respect to the lining shell 14. The grouting sleeve 7, which extends up to the vertical leg 8 of the L-shaped rail 3 and the forward opening of which is held together at that point by a rubber ring 27, constitutes an additional, widening bulb between the L-shaped rail 3 and the lining shell 14, likewise exerting a supporting function. A thermal insulating layer 28 is inserted in the free space between the old lining shell 14 and the L-shaped rail 3.

The horizontal legs 9 of the L-shaped rails 3 each carry panel members 29 arranged in superimposed and side-by-side relationship, with the panel members 29 together forming the facade shell 13. Any condensed moisture produced in the air layer between the curtain facade 13 and the lining shell 14 and any precipitation moisture that may have penetrated through the curtain facade 13 is conducted downwardly along the rear side 33 of the panel members 29 and drains to the bottom respectively over the ends of the horizontal leg 9 of the L-shaped rails 3. The water can freely flow into the ground 35 at the lower rim of the facade shell 13; compare FIG. 4.

Figure 6:
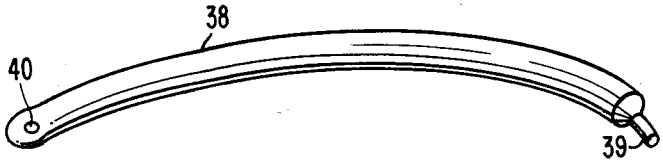
FIG. 6 is a view of a joint tube associated with a support element.

The connecting joint, between the topside of a panel member 29 and the L-shaped rail 3 disposed thereabove, is sealed by a joint tube 38 provided with an injection opening 39 for the injection of mortar. In order to be able to attain complete filling of the joint tube 38, the latter furthermore has an air outlet port 40; compare FIG. 6.

The vertical leg 8 of the L-shaped rails 3 is provided with horizontally oriented slotted holes 41 for the threading-in ends 19 of the anchoring bolts 5. By only moderately tightening the screws 11, and by providing the washers 12 with a smooth, low-friction surface, it is possible to establish, by the slotted holes 41, a temperature equalization between the foundation masonry 14, 15 and the facade shell 13. In the illustrated embodiment, the screws 11 are threaded directly into the grouting bores 18 so that, during hardening of the grouting compound 20, the screws 11 are glued in place. Therefore, the screws cannot become loose on their own even in case of very high thermal expansions. It is, of course, also basically possible to design the grouting bores and the threading bores separately from one another and to provide different security measures for the screws 11.

Figure 7:
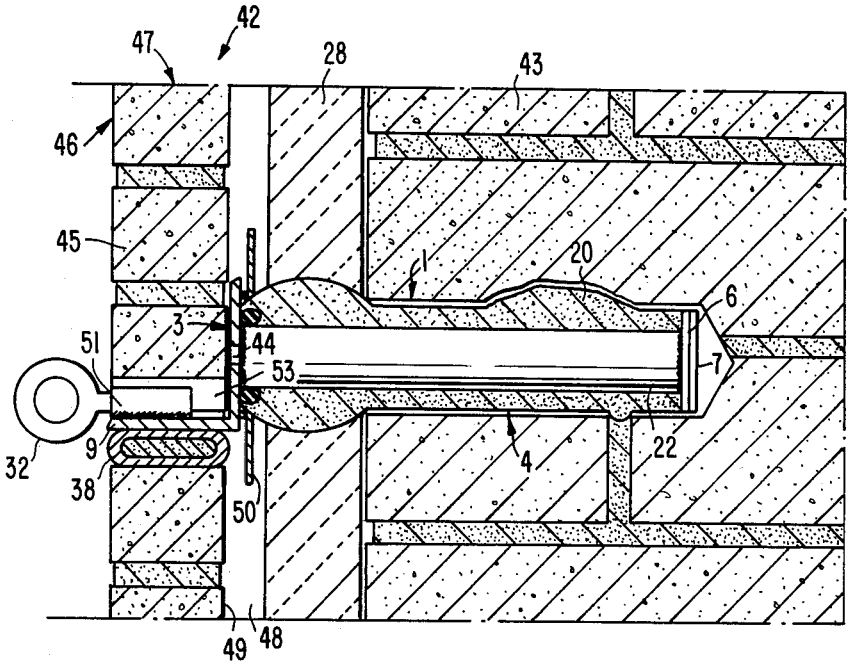
FIG. 7 is a cross-sectional view of an alternative embodiment of a curtain facade attached to a single-shell foundation masonry.

In the embodiment of FIG. 7, a curtain facade 42 is illustrated, attached to a single-shell foundation masonry 43. Support elements 1 according to FIG. 1 are provided for anchoring, the grouting anchors 4 being welded to the L-shaped rails 3. For this reason, the vertical legs 8 of the L-shaped rails 3 exhibit a grouting opening 44 for the grouting compound 20. Normal facing stones 45 are bricked onto the horizontal leg 9 of the L-shaped rails 3, these stones constituting the individual paneling members 46 of the facade shell 47. The facing stones 45 are in direct contact with the vertical leg 8 of the L-shaped rails 3. The grouting anchors 4, however, are inserted in the foundation masonry 43 so that they project away to such a degree that even if a thermal insulating layer 28 is inserted there still remains an air space 48 permitting efficient drainage of water along the rear side 49 of the facade shell 47. In order to prevent transfer of the water to the thermal insulating layer 28 and to the basic masonry 43 in the zone of the grouting anchors 4, the grouting anchors 4 carry drip plates 50 shortly behind the vertical legs 8 of the L-shaped rails 3.

FIG. 7 furthermore shows a connecting element 51 for a rope anchoring eye 52 which latter is welded to the L-shaped rail 3. The connecting element 51 is an internally threaded bushing in the illustrated example; if necessary, scaffoldings or the like can also be fastened to this bushing. The facing stone laid in the zone of the connecting element 51 on the L-shaped rail 3 is provided with a corresponding recess 53. Such connecting elements 51 can, of course, also be arranged in an embodiment according to FIGS. 3–5.

Figure 9:
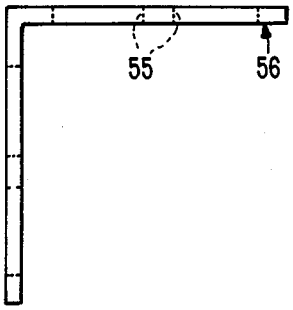
FIG. 9 is a side view of an angular connecting fishplate for internal and external corners.
Figure 8:
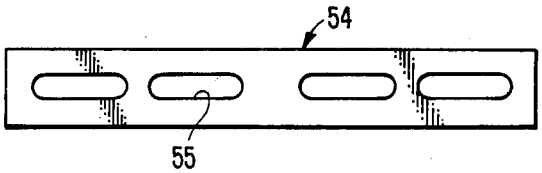
FIG. 8 is a plan view of an associated connecting fishplate.

FIG. 8 shows a connecting fishplate 54 for the lateral joining of two neighboring support elements 1. The fishplate 54 is provided with slotted holes 55 extending in its longitudinal direction for the compensation of temperature fluctuations and is threaded to the vertical legs of the L-shaped rails 3. FIG. 9 illustrates an angular connecting fishplate 56 for internal and external corners, likewise provided with slotted holes 55.

I claim:

1. A bracket-style support element for curtain facades on building walls, said support element comprising:

a plurality of grouting anchors adapted to be inserted in predrilled blind holes in the building wall, with the blind holes being arranged horizontally adjacent to one another and spaced in pairs at equal intervals, each of said grouting anchors including a hollow anchoring bolt having a central channel for accommodating the grouting material;

a barbed disc provided at an insertion end of each of said anchoring bolts, each of said anchoring bolts including at least one outlet opening for enabling a discharge of the grouting material;

a grouting sleeve provided for each grouting anchor and surrounding the anchoring bolt;

sealing means provided at a forward end of the anchoring bolt so as to hold the respective grouting sleeves, said sealing means being disposed with an inwardly delimiting longitudinal segment of the anchoring bolt and grouting sleeve in a forward area of the opening of the blind hole in the building wall whereby, when the grouting material is forced into the anchoring bolt, a segment of the grouting sleeve located forwardly of the opening expands and an anchoring bulb is formed which fits around an opening of the blind hole and abuts a front of the building wall and the grouting sleeve is laterally expanded in the blind hole in the masonry wall forming a grouting material plug with internal anchoring projections, and said barbed disc is anchored in the blind hole by the grouting material plug;

said support element further comprising:

an L-shaped rail associated with each pair of grouting anchors, said L-shaped rail having a vertical leg from which the fastened grouting anchors project, said L-shaped rail including a horizontal support leg extending away from the building wall; and a joint tube adapted to be inserted between adjacent curtain facades of the building wall, said joint tube being disposed at an underside of the horizontal leg support of the L-shaped rail, said joint tube being provided with an injection opening for enabling an injection of mortar whereby a plurality of curtain facades, joint tubes, and L-shaped rails produce a continuous supporting second masonry wall which is joined by said grouting anchors with the original masonry wall forming a statically stable double wall.

2. A bracket support element according to claim 1, wherein the horizontal leg of the support is approximately of equal width to that of panel members forming the curtain facade, and wherein at least one drip plate means is arranged on the respective grouting anchors at a small distance behind the vertical leg.

3. A bracket-style support element according to one of claims 1 or 2, wherein the anchoring bolts are welded to the vertical leg of the L-shaped rail.

4. A bracket-style support element according to claim 1, wherein said joint tube has a length substantially the same as a length of the L-shaped rail.

5. A bracket-style support element according to claim 1, wherein the anchoring bolts have a length of more than 30 cm.

6. A bracket-style support element according to claim 1, wherein means are provided for enabling attachment of scaffoldings or rope to the support element.

7. A bracket-style support element according to claim 1, characterized in that the anchoring bolts are fashioned as rectangular pipes.

8. A bracket-style support element according to claim 1, further comprising fishplate means for enabling a connection to respectively adjacent support elements, and wherein the fishplate means are provided with slotted holes extending in a longitudinal direction thereof for enabling temperature compensation movements.

9. A bracket-style support element according to claim 8, further comprising an angular connecting fishplate means for support elements disposed adjacent a zone of external and internal corners.

10. A bracket-style element according to one of claims 1 or 2, wherein the anchoring bolts are threaded to the vertical leg of the L-shaped rail.

11. A bracket-style support element according to claim 10, wherein the vertical leg of the L-shaped rail includes horizontally oriented slotted holes for accommodating threaded ends of the anchoring bolts.

12. A bracket-style support element according to claim 11, wherein said joint tube has a length substantially the same as a length of the L-shaped rail.

13. A bracket-style support element according to claim 12, wherein the anchoring bolts have a length of more than 30 cm.

14. A bracket-style support element according to claim 13, wherein means are provided for enabling attachment of scaffoldings or rope to the support element.

15. A bracket-style support element according to claim 14, further comprising fishplate means for enabling a connection to respectively adjacent support elements, and wherein the fishplate means are provided with slotted holes extending in a longitudinal direction thereof for enabling temperature compensation movements.

16. A bracket-style support element according to claim 15, further comprising an angular connecting fishplate means for support elements disposed adjacent a zone of external and internal corners.

17. A bracket-style support element according to claim 16, characterized in that the anchoring bolts are fashioned as rectangular pipes.

* * * * *